US009790801B2

(12) United States Patent
Spangler

(10) Patent No.: US 9,790,801 B2
(45) Date of Patent: Oct. 17, 2017

(54) GAS TURBINE ENGINE COMPONENT HAVING SUCTION SIDE CUTBACK OPENING

(71) Applicant: Brandon W. Spangler, Vernon, CT (US)

(72) Inventor: Brandon W. Spangler, Vernon, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 892 days.

(21) Appl. No.: 13/728,342

(22) Filed: Dec. 27, 2012

(65) Prior Publication Data

US 2014/0212270 A1 Jul. 31, 2014

(51) Int. Cl.
*F01D 5/18* (2006.01)

(52) U.S. Cl.
CPC ..... *F01D 5/186* (2013.01); *F01D 5/187* (2013.01); *F05D 2240/304* (2013.01); *F05D 2250/52* (2013.01)

(58) Field of Classification Search
CPC F01D 5/141; F01D 5/186; F01D 5/18–5/187; F05D 2240/121; F05D 2240/122; F05D 2240/123; F05D 2240/124; F05D 2240/126; F05D 2240/303; F05D 2240/304; F05D 2240/305; F05D 2240/306; F05D 2250/52; F05D 2250/294; F05D 2260/202; F05D 2260/221; F05D 2260/2214; F05D 2260/22141
See application file for complete search history.

(56) References Cited

U.S. PATENT DOCUMENTS 2,656,147 A * 10/1953 Brownhill ..... F01D 5/084 416/193 A
4,229,140 A * 10/1980 Scott ..... F01D 5/141 415/115
4,601,638 A 7/1986 Hill et al.
4,726,735 A 2/1988 Field et al.
5,243,759 A * 9/1993 Brown ..... B22C 9/10 164/122.1
5,378,108 A 1/1995 Zelesky
6,022,188 A 2/2000 Bancalari
6,126,397 A 10/2000 Kvasnak et al.
(Continued)

FOREIGN PATENT DOCUMENTS

EP 1262631 A2 12/2002

OTHER PUBLICATIONS

International Search Report and Written Opinion for PCT Application No. PCT/US2013/075963 dated Apr. 4, 2014.
(Continued)

*Primary Examiner* — Stephen M Johnson
*Assistant Examiner* — Joshua Semick
(74) *Attorney, Agent, or Firm* — Carlson, Gaskey & Olds

(57) ABSTRACT

An airfoil for a gas turbine engine, according to an exemplary aspect of the present disclosure includes, among other things, a pressure side wall and a suction side wall spaced apart from the pressure side wall and each extending between a leading edge portion and a trailing edge portion. A plurality of cutback openings are spaced along a radial axis of the suction side wall.

8 Claims, 3 Drawing Sheets

(56) References Cited

U.S. PATENT DOCUMENTS 6,287,075 B1 * 9/2001 Kercher ..... F01D 5/186 415/115
6,325,593 B1 * 12/2001 Darkins, Jr. ..... F01D 5/186 415/115
6,328,531 B1 * 12/2001 Bariaud ..... F01D 5/141 416/97 R
6,422,819 B1 7/2002 Tsai et al.
6,979,176 B2 * 12/2005 Nakamata ..... F01D 5/186 416/97 R
7,125,225 B2 * 10/2006 Surace ..... F01D 5/16 416/224
7,165,940 B2 1/2007 McGrath et al.
7,306,424 B2 * 12/2007 Romanov et al. ..... 415/115
7,465,154 B2 12/2008 Devore et al.
7,549,844 B2 * 6/2009 Liang ..... F01D 5/187 415/177
7,625,178 B2 * 12/2009 Morris ..... F01D 5/187 29/889.7
7,845,906 B2 12/2010 Spangler et al.
7,980,821 B1 * 7/2011 Liang ..... F01D 5/187 416/96 R
8,011,889 B1 9/2011 Liang
8,079,813 B2 * 12/2011 Liang ..... F01D 5/187 416/96 R
8,092,175 B2 * 1/2012 Beeck ..... F01D 5/145 416/223 R
8,096,771 B2 1/2012 Liang
8,573,923 B2 * 11/2013 Tibbott ..... F01D 5/186 415/115
2003/0044279 A1 3/2003 Leeke et al.
2008/0050243 A1 2/2008 Liang
2008/0273988 A1 11/2008 Tibbott et al.
2008/0279696 A1 11/2008 Liang
2010/0183429 A1 7/2010 Liang
2010/0226788 A1 * 9/2010 Liang ..... F01D 5/187 416/97 R
2014/0037460 A1 * 2/2014 Saxer-Felici ..... F01D 5/186 416/97 R
2014/0154066 A1 * 6/2014 Mukhopadhyay ..... F01D 5/186 415/191

OTHER PUBLICATIONS

International Preliminary Report on Patentability for PCT Application No. PCT/US2013/075963, mailed Jul. 9, 2015.
Extended European Search Report for Application No. EP 13 86 9160 dated Sep. 30, 2016.

* cited by examiner

GAS TURBINE ENGINE COMPONENT HAVING SUCTION SIDE CUTBACK OPENING

BACKGROUND

This disclosure relates to a gas turbine engine, and more particularly to a gas turbine engine component that includes a suction side cutback opening.

Gas turbine engines typically include a compressor section, a combustor section and a turbine section. In general, during operation, air is pressurized in the compressor section and is mixed with fuel and burned in the combustor section to generate hot combustion gases. The hot combustion gases flow through the turbine section which extracts energy from the hot combustion gases to power the compressor section and other gas turbine engine loads.

Due to exposure to hot combustion gases, numerous components of the gas turbine engine may include cooling circuits that circulate cooling airflow throughout various internal and external surfaces of the components during engine operation. Certain portions of components may be difficult to cool notwithstanding such internal cooling circuits. In addition, cooling airflow must typically be extracted from the gas path of upstream sections of the gas turbine engine which can result in efficiency losses.

SUMMARY

An airfoil for a gas turbine engine, according to an exemplary aspect of the present disclosure includes, among other things, a pressure side wall and a suction side wall spaced apart from the pressure side wall and each extending between a leading edge portion and a trailing edge portion. A plurality of cutback openings are spaced along a radial axis of the suction side wall.

In a further non-limiting embodiment of the foregoing airfoil, the plurality of cutback openings are positioned at the trailing edge portion of the suction side wall.

In a further non-limiting embodiment of either of the foregoing airfoils, at least a portion of the plurality of cutback openings are slots.

In a further non-limiting embodiment of any of the foregoing airfoils, the plurality of cutback openings are positioned along an entire radial span of the suction side wall.

In a further non-limiting embodiment of any of the foregoing airfoils, a rib extends between adjacent cutback openings of the plurality of cutback openings.

In a further non-limiting embodiment of any of the foregoing airfoils, the airfoil includes at least one film cooling hole at the trailing edge portion of the pressure side wall.

In a further non-limiting embodiment of any of the foregoing airfoils, the airfoil includes at least one film cooling hole in a gas path accelerating region of the suction side wall.

In a further non-limiting embodiment of any of the foregoing airfoils, a gas path decelerating region of the suction side wall does not include film cooling holes.

In a further non-limiting embodiment of any of the foregoing airfoils, cooling airflow is communicated through each of the plurality of cutback openings at a surface angle that is less than about 10 degrees relative to an exterior surface of the suction side wall.

A component for a gas turbine engine, according to an exemplary aspect of the present disclosure includes, among other things, a body portion that includes a pressure side wall and a suction side wall spaced apart from the pressure side wall. A plurality of cutback openings are spaced along a radial axis of the suction side wall.

In a further non-limiting embodiment of the foregoing component, the body portion is an airfoil of a blade.

In a further non-limiting embodiment of either of the foregoing components, the body portion is part of a blade outer air seal (BOAS).

In a further non-limiting embodiment of any of the foregoing components, the plurality of cutback openings are part of a cooling circuit disposed inside the body portion that also includes at least a first cavity and a second cavity in fluid communication with the first cavity.

In a further non-limiting embodiment of any of the foregoing components, the plurality of cutback openings are positioned at a trailing edge portion of the body portion.

In a further non-limiting embodiment of any of the foregoing components, the component comprises at least one film cooling hole at a trailing edge portion of the pressure side wall.

In a further non-limiting embodiment of any of the foregoing components, a gas path decelerating region of the suction side wall does not include film cooling holes.

A gas turbine engine, according to an exemplary aspect of the present disclosure includes, among other things, a compressor section, a combustor section in fluid communication with the compressor section, and a turbine section in fluid communication with the combustor section. A first component is disposed in at least one of the compressor section and the turbine section. The first component includes a body portion having a pressure side wall and a suction side wall spaced apart from the pressure side wall and that each extend between a leading edge portion and a trailing edge portion. A plurality of cutback openings are spaced along a radial axis of the suction side wall.

In a further non-limiting embodiment of the foregoing gas turbine engine, a second component is circumferentially adjacent to the first component. A gauge area extends between a trailing edge portion of the second component and the suction side wall of the first component.

In a further non-limiting embodiment of either of the foregoing gas turbine engines, the suction side wall includes a gas path accelerating region upstream from the gauge area and a gas path decelerating region downstream from the gauge area.

In a further non-limiting embodiment of any of the foregoing gas turbine engines, the gas path accelerating region includes at least one film cooling hole and the gas path decelerating region does not include film cooling holes.

The various features and advantages of this disclosure will become apparent to those skilled in the art from the following detailed description. The drawings that accompany the detailed description can be briefly described as follows.

DETAILED DESCRIPTION

Figure 1:
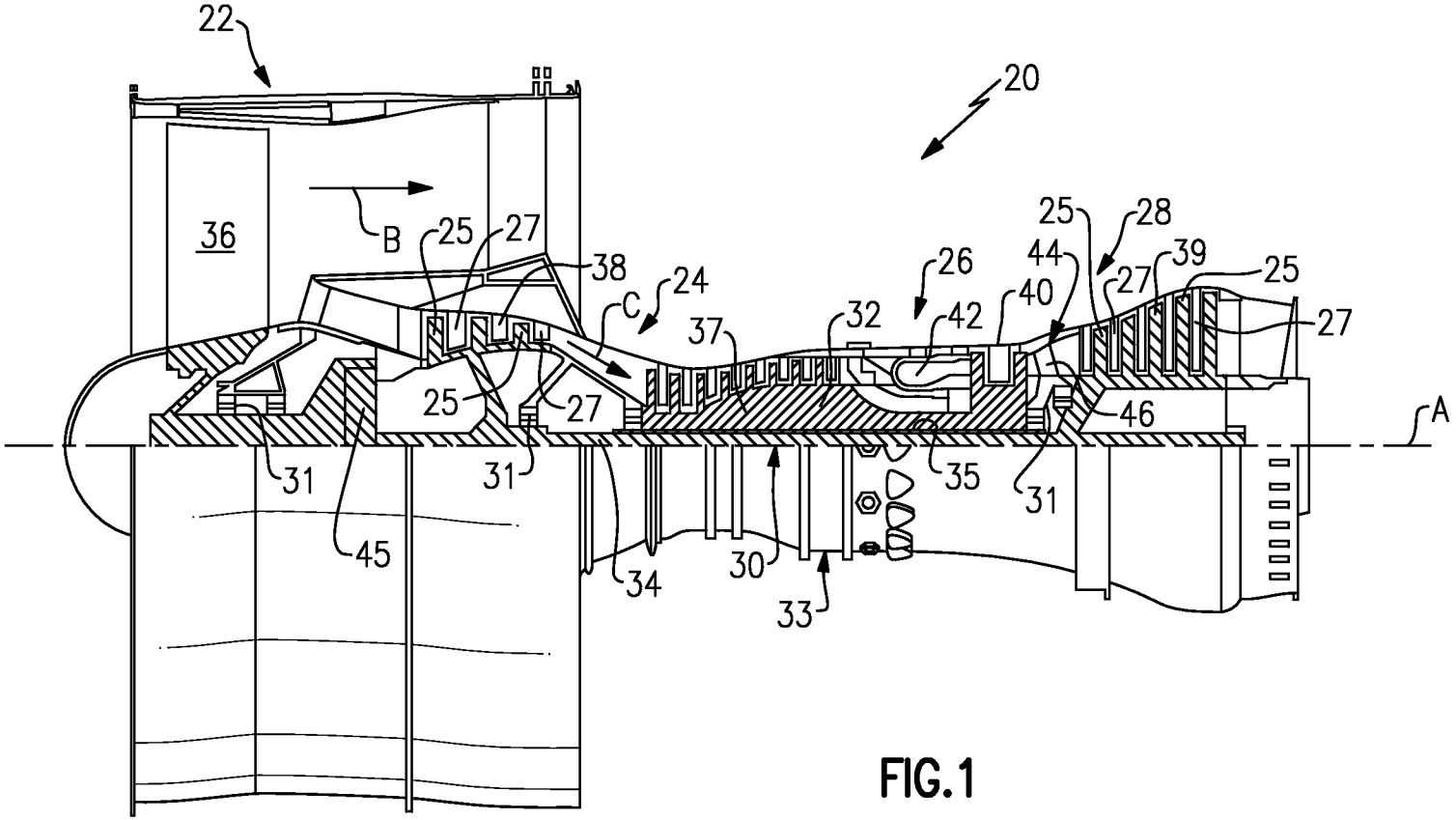
FIG. 1 illustrates a schematic, cross-sectional view of a gas turbine engine.

FIG. 1 schematically illustrates a gas turbine engine 20. The exemplary gas turbine engine 20 is a two-spool turbofan engine that generally incorporates a fan section 22, a compressor section 24, a combustor section 26 and a turbine section 28. Alternative engines might include an augmenter section (not shown) among other systems for features. The fan section 22 drives air along a bypass flow path B, while the compressor section 24 drives air along a core flow path C for compression and communication into the combustor section 26. The hot combustion gases generated in the combustor section 26 are expanded through the turbine section 28. Although depicted as a turbofan gas turbine engine in the disclosed non-limiting embodiment, it should be understood that the concepts described herein are not limited to turbofan engines and these teachings could extend to other types of engines, including but not limited to, three-spool engine architectures.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that other bearing systems 31 may alternatively or additionally be provided.

The low speed spool 30 generally includes an inner shaft 34 that interconnects a fan 36, a low pressure compressor 38 and a low pressure turbine 39. The inner shaft 34 can be connected to the fan 36 through a geared architecture 45 to drive the fan 36 at a lower speed than the low speed spool 30. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 can support one or more bearing systems 31 of the turbine section 28. The mid-turbine frame 44 may include one or more airfoils 46 that extend within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded over the high pressure turbine 40 and the low pressure turbine 39. The high pressure turbine 40 and the low pressure turbine 39 rotationally drive the respective high speed spool 32 and the low speed spool 30 in response to the expansion.

The pressure ratio of the low pressure turbine 39 can be pressure measured prior to the inlet of the low pressure turbine 39 as related to the pressure at the outlet of the low pressure turbine 39 and prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 38, and the low pressure turbine 39 has a pressure ratio that is greater than about five (5:1). It should be understood, however, that the above parameters are only exemplary of one embodiment of a geared architecture engine and that the present disclosure is applicable to other gas turbine engines, including direct drive turbofans.

In this embodiment of the exemplary gas turbine engine 20, a significant amount of thrust is provided by the bypass flow path B due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $[(\text{Tram}^\circ\ \text{R})/(518.7^\circ\ \text{R})]^{0.5}$, where T represents the ambient temperature in degrees Rankine. The Low Corrected Fan Tip Speed according to one non-limiting embodiment of the example gas turbine engine 20 is less than about 1150 fps (351 m/s).

Each of the compressor section 24 and the turbine section 28 may include alternating rows of rotor assemblies and vane assemblies (shown schematically) that carry airfoils that extend into the core flow path C. For example, the rotor assemblies can carry a plurality of rotating blades 25, while each vane assembly can carry a plurality of vanes 27 that extend into the core flow path C. The blades 25 of the rotor assemblies create or extract energy (in the form of pressure) from the core airflow that is communicated through the gas turbine engine 20 along the core flow path C. The vanes 27 of the vane assemblies direct the core airflow to the blades 25 to either add or extract energy.

Various components of a gas turbine engine 20, including but not limited to the airfoils of the blades 25 and the vanes 27 of the compressor section 24 and the turbine section 28, may be subjected to repetitive thermal cycling under widely ranging temperatures and pressures. The hardware of the turbine section 28 is particularly subjected to relatively extreme operating conditions. Therefore, some components may require internal cooling circuits for cooling the parts during engine operation. Example cooling circuits that include features such as suction side cutback openings are discussed below.

Figure 2:
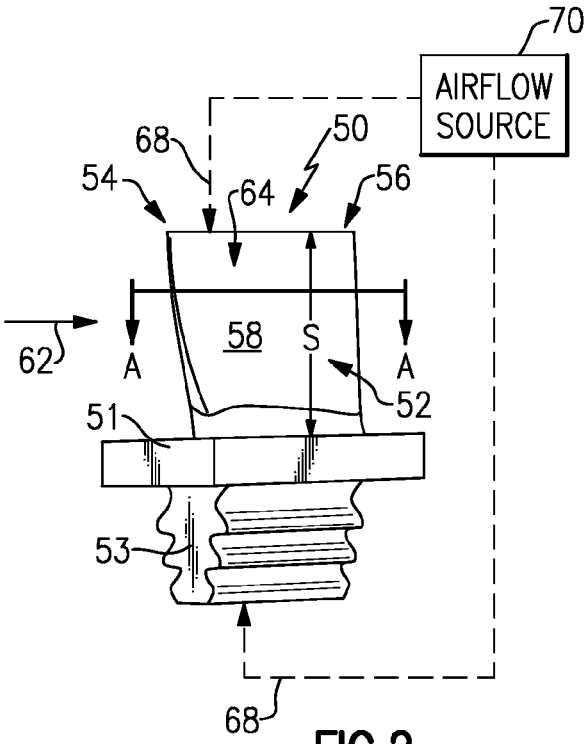
FIG. 2 illustrates a component that can be incorporated into a gas turbine engine.
Figure 3:
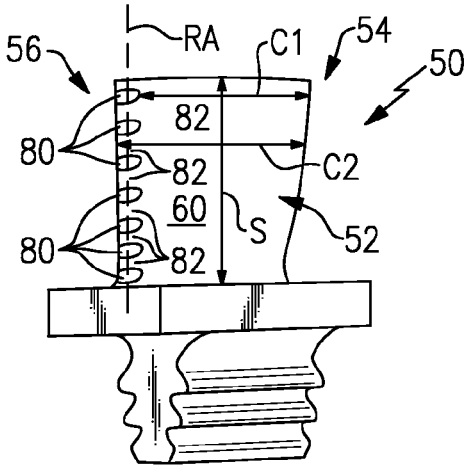
FIG. 3 illustrates a suction side view of the component of FIG. 2.
Figure 4:
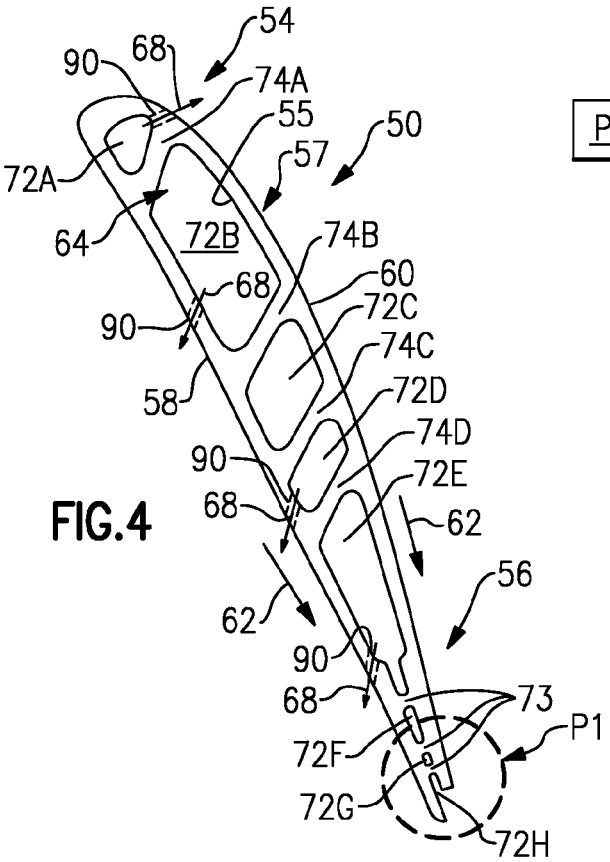
FIG. 4 illustrates a cross-sectional view through section A-A of FIG. 2.

FIGS. 2, 3 and 4 illustrate a component 50 that can be incorporated into a gas turbine engine, such as the gas turbine engine 20 of FIG. 1. The component 50 includes a body portion 52 that axially extends between a leading edge portion 54 and a trailing edge portion 56. The body portion 52 also includes a pressure side wall 58 (see FIG. 2) and a suction side wall 60 (see FIG. 3) that are spaced apart from one another and axially extend between the leading edge portion 54 and the trailing edge portion 56.

In this embodiment, the body portion 52 is representative of an airfoil. For example, the body portion 52 could be an airfoil that extends from a platform portion 51 that is connected to a root portion 53, or could alternatively extend between inner and outer platforms where the component 50 is a vane (not shown). In yet another embodiment, the component 50 could be a non-airfoil component, including but not limited to, a blade outer air seal (BOAS), a combustor liner, a turbine exhaust case liner, or any other part that may require dedicated cooling.

A gas path 62 is communicated axially downstream through the gas turbine engine 20 along the core flow path C in a direction that extends from the leading edge portion 54 toward the trailing edge portion 56 of the body portion 52. The gas path 62 represents the communication of core airflow along the core flow path C (see FIG. 1). The body portion 52 may extend radially across a span S.

A cooling circuit 64 (best seen in FIG. 4) may be disposed inside of the body portion 52 for cooling the internal and external surfaces of the component 50. For example, the cooling circuit 64 can include one or more cavities that may radially, axially and/or circumferentially extend inside of the body portion 52 to establish cooling passages for receiving a cooling airflow 68 to cool the component 50. The cooling airflow 68 may be communicated into one or more of the cavities from an airflow source 70 that is external to the component 50. The cooling airflow 68 can be communicated into an inlet at either the body portion 52 or the root portion 53, for example.

The cooling airflow 68 is generally of a lower temperature than the airflow of the gas path 62 that is communicated across the body portion 52. In one particular embodiment, the cooling airflow 68 is a bleed airflow that can be sourced from the compressor section 24 or any other portion of the gas turbine engine 20 that is upstream from the component 50. The cooling airflow 68 can be circulated through the cooling circuit 64 to transfer thermal energy from the component 50 to the cooling airflow 68 thereby cooling the internal and external surfaces of the component 50.

As best illustrated in FIG. 3, the component 50 can include a plurality of cutback openings 80 that are part of the cooling circuit 64. The cutback openings 80 are removed sections in the suction side wall 60 of the component 50 that establish passages for expelling the cooling airflow 68 from the cooling circuit 64. As removed sections, a chord C1 of the body portion 52 that extends through a centerline of each cutback opening 80 extends a shorter distance than the chord C2 of the entire axial distance of the suction side wall 60. In other words, a distal most portion 77 of suction side wall 60 is offset (by an axial distance D1) from a distal most portion 79 of the pressure side wall 58 at each cutback opening 80 (see FIG. 5).

The cutback openings 80 can be positioned to extend along the trailing edge portion 56 of the component 50. In this manner, the cooling circuit 64 can adequately cool the trailing edge portion 56 of the suction side wall 60 in a manner that requires the communication of a relatively small amount of cooling airflow 68 to the suction side wall 60. The cutback openings 80 could be alternatively positioned at other locations along the suction side wall 60.

A plurality of cutback openings 80 can be spaced along a radial axis RA of the suction side wall 60. The radial axis RA is generally parallel to the span S of the body portion 52. A rib 82 can extend between adjacent cutback openings 80. The chord C2 extends through each rib 82, in this embodiment. In one embodiment, the plurality of cutback openings 80 extend along the entire span S of the suction side wall 60. The number of cutback openings 80 that are formed into the suction side wall 60 can vary depending upon design specific parameters including but not limited to the cooling requirements of the component 50.

In one embodiment, the plurality of cutback openings 80 are slots. In another embodiment, the cutback openings 80 are thumbnail shaped. However, the plurality of cutback openings 80 could embody other shapes within the scope of this disclosure.

The cutback openings 80 may be cast features of the component 50. However, other techniques can also be utilized to manufacture the cutback openings 80 into the component 50.

FIG. 4 illustrates additional features of the cooling circuit 64 that can be disposed inside of the component 50. The pressure side wall 58 and the suction side wall 60 include interior surfaces 55 as well as exterior surfaces 57 (i.e., gas path surfaces). The interior surfaces 55 are remote from the gas path 62 and establish portions of the cooling circuit 64, whereas the exterior surfaces 57 are positioned within the gas path 62. The cooling circuit 64 can communicate cooling airflow 68 to cool both the interior surfaces 55 and the exterior surfaces 57.

In this embodiment, the exemplary cooling circuit 64 includes a first cavity 72A (i.e., a leading edge cavity), a second cavity 72B (i.e., a first intermediate cavity), a third cavity 72C (i.e., a second intermediate cavity), a fourth cavity 72D (i.e., a third intermediate cavity), and a plurality of trailing edge cavities 72E, 72F, 72G and 72H. However, the cooling circuit 64 could alternatively include a greater or fewer number of cavities. The cavities 72A, 72B, 72C, 72D, 72E, 72F, 72G and 72H can communicate the cooling airflow 68 through the cooling circuit 64, including along a serpentine path, to cool the body portion 52. In other words, the cavities 72A through 72H may be in fluid communication with one another in order to circulate the cooling airflow 68 throughout the cooling circuit 64.

Ribs 74 may extend between the pressure side wall 58 and the suction side wall 60 of the body portion 52. In this particular embodiment, a first rib 74A is positioned between the first cavity 72A and the second cavity 72B, a second rib 74B is positioned between the second cavity 72B and the third cavity 72C, a third rib 74C is positioned between the third cavity 72C and the fourth cavity 72D and a fourth rib 74D is positioned between the fourth cavity 72D and the fifth cavity 72E. The trailing edge cavities 72E, 72F, 72G and 72H may include one or more pedestals 73.

Figure 5:
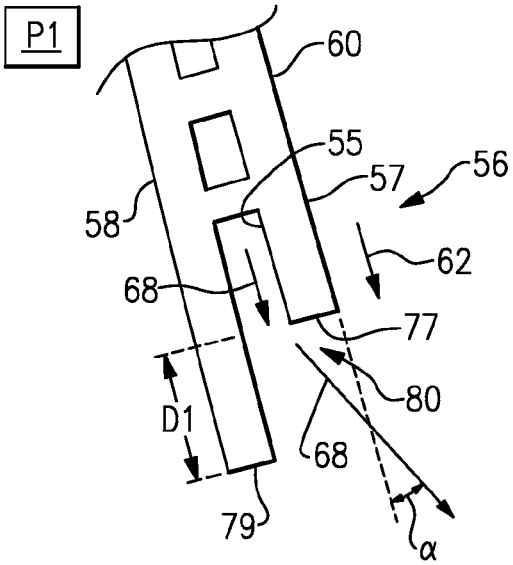
FIG. 5 illustrates a blown-up view of portion P1 of FIG. 4.

Cooling airflow 68 from the cooling circuit 64 can be communicated through the plurality of cutback openings 80 and returned to the gas path 62. In one embodiment, the cooling airflow 68 is injected through the plurality of cutback openings 80 at a low surface angle. For example, as shown in FIG. 5, the cooling airflow 68 can be injected through the cutback openings 80 at a surface angle $\alpha$ that is less than about 10° relative to the exterior surface 57 of the suction side wall 60. In this manner, the cooling airflow 68 can be introduced in both accelerating and decelerating regions of the component 50 with relatively minimal mixing losses.

The component 50 can also include a plurality of film cooling holes 90. The film cooling holes 90 can be disposed on the pressure side wall 58 and on portions of the suction side wall 60. For example, the leading edge portion 54 of the suction side wall 60 can include one or more film cooling holes 90. In this embodiment, the trailing edge portion 56 of the suction side wall 60 is free of film cooling holes.

Figure 6:
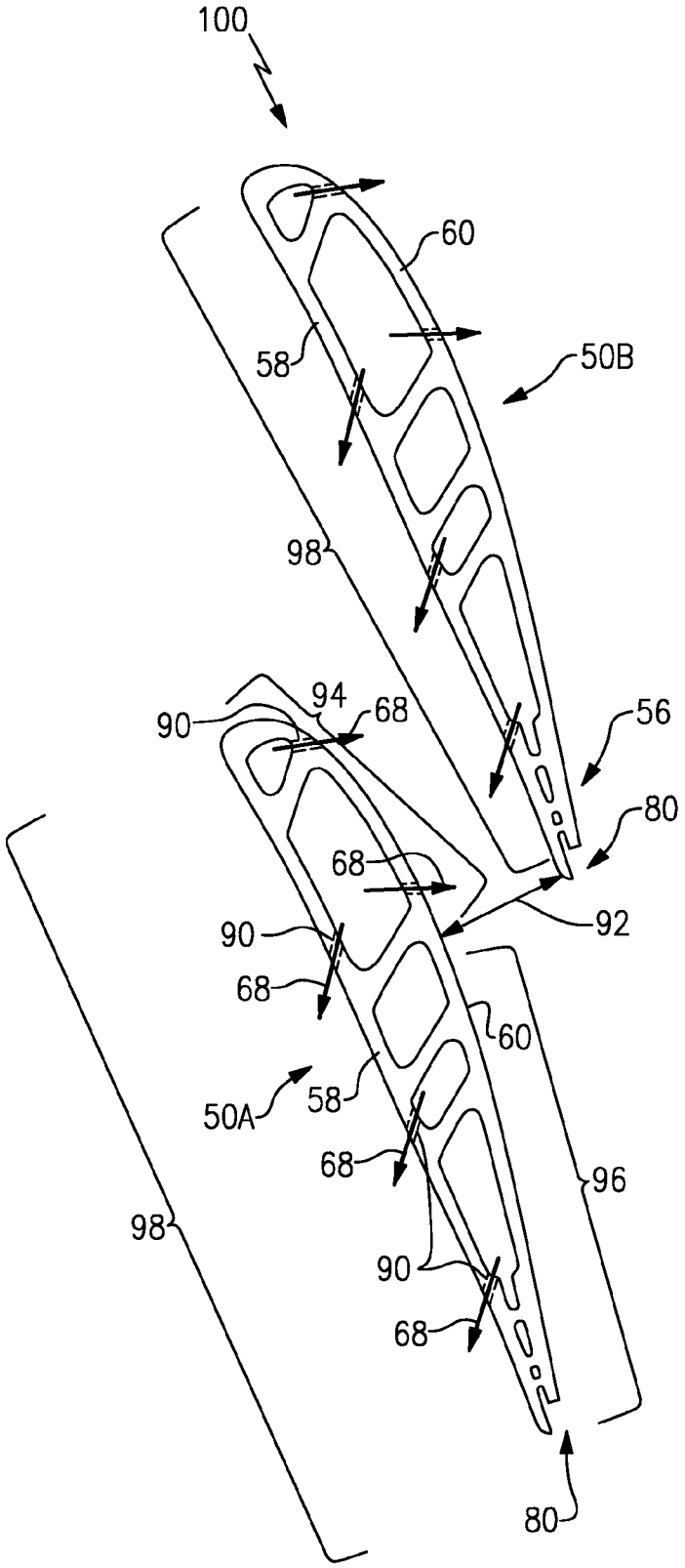
FIG. 6 illustrates a portion of an assembly that can be incorporated into a gas turbine engine.

FIG. 6 illustrates portions of an assembly 100, such as a rotor assembly, that can be incorporated into either the compressor section 24 or turbine section 28 of the gas turbine engine 20. This particular assembly 100 incorporates at least a first component 50A and a second component 50B that each include cutback openings 80. The first and second components 50A and 50B are circumferentially adjacent to one another and are positioned about the assembly 100. Although two components 50A, 50B are illustrated, the assembly 100 could include any number of components.

A gauge area 92 (i.e., a throat area between the first component 50A and the second component 50B) extends between the trailing edge portion 56 of the second component 50B and the suction side wall 60 of the first component 50A. The gauge area 92 divides the suction side wall 60 into a gas path accelerating region 94 and a gas path decelerating region 96. In this example, the gas path accelerating region 94 of the suction side wall 60 of the first component 50A is upstream of the gauge area 92 and the gas path decelerating region 96 is downstream from the gauge area 92. Since the entire chord of the pressure side wall 58 is upstream from the gauge area 92, the pressure side wall 58 includes a gas path accelerating region 98 only.

In one embodiment, the gas path accelerating region 94 of the suction side wall 60 of the first component 50A includes one or more film cooling holes 90. However, no film cooling holes 90 are located within the gas path decelerating region 96 of the suction side wall 60. Therefore, the first component 50A does not include film cooling holes 90 in the trailing edge portion 56 of the suction side wall 60. The cutback openings 80 provide the cooling in this region of the component 50A. Film cooling holes 90 can be located along any portion (including the trailing edge portion 56) of the pressure side wall 58 since it includes a gas path accelerating region 98 and no decelerating region.

The cutback openings 80 described in this disclosure may provide more efficient cooling in low loss regions of a component 50, including at the trailing edge, suction side wall. Moreover, the cooling airflow 68 can be injected into gas path accelerating and decelerating regions of the suction side wall 60 with minimal loss by injecting the airflow at relatively low surface angles. Other features such as film cooling holes 90 can also be incorporated to effectively cool the trailing edge, pressure side of the component.

Although the different non-limiting embodiments are illustrated as having specific components, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. An airfoil for a gas turbine engine, comprising:

a pressure side wall and a suction side wall spaced apart from said pressure side wall and each extending between a leading edge portion and a trailing edge portion;

a plurality of cutback openings formed in said suction side wall and that are spaced along a radial axis of said suction side wall such that a distal most portion of said suction side wall is offset from a distal most portion of said pressure side wall at each of said plurality of cutback openings;

said pressure side wall excluding any cutback openings at said trailing edge portion; and wherein a gas path decelerating region of said suction side wall does not include film cooling holes.

2. The airfoil as recited in claim 1, wherein said plurality of cutback openings are positioned at said trailing edge portion of said suction side wall.

3. The airfoil as recited in claim 1, wherein at least a portion of said plurality of cutback openings are slots.

4. The airfoil as recited in claim 1, wherein said plurality of cutback openings are positioned along an entire radial span of said suction side wall.

5. The airfoil as recited in claim 1, wherein a rib extends between adjacent cutback openings of said plurality of cutback openings.

6. The airfoil as recited in claim 1, comprising at least one film cooling hole at said trailing edge portion of said pressure side wall.

7. The airfoil as recited in claim 1, comprising at least one film cooling hole in a gas path accelerating region of said suction side wall.

8. The airfoil as recited in claim 1, wherein said distal most portion of said pressure side wall extends distally further than said distal most portion of said suction side wall.

* * * * *